United States Patent [19]

Akagi

[11] 4,436,247

[45] Mar. 13, 1984

[54] FUEL INJECTION NOZZLE AND HOLDER ASSEMBLY FOR INTERNAL COMBUSTION ENGINES

[75] Inventor: Jiro Akagi, Oyama, Japan

[73] Assignee: Kabushiki Kaisha Komatsu Seisakusho, Tokyo, Japan

[21] Appl. No.: 367,985

[22] Filed: Apr. 13, 1982

[30] Foreign Application Priority Data

Oct. 29, 1981 [JP] Japan ..... 56-160228[U]

[51] Int. Cl.[3] ..... F02M 61/08

[52] U.S. Cl. ..... 239/533.7; 239/533.9

[58] Field of Search ..... 239/533.2–533.7, 239/533.8–533.12, 584

[56] References Cited

U.S. PATENT DOCUMENTS

| | | | |
|---|---|---|---|
| 3,910,503 | 10/1975 | Barber | 239/533.8 |
| 4,200,231 | 4/1980 | Knape | 239/533.8 X |
| 4,215,821 | 8/1980 | Eblen | 239/533.4 |
| 4,285,471 | 8/1981 | Eblen et al. | 239/533.8 X |

*Primary Examiner*—John J. Love
*Assistant Examiner*—Mary McCarthy
*Attorney, Agent, or Firm*—Armstrong, Nikaido, Marmelstein & Kubovcik

[57] ABSTRACT

A diesel fuel injection nozzle and holder assembly includes a tubular nozzle holder carrying a nozzle on one end and defining, in combination therewith, a storage chamber for receiving successive charges of fuel under pressure via a check valve mounted therein. A needle valve, complete with a stem, mounted in the storage chamber is urged by a first spring toward a position for closing spray orifices in the nozzle. Disposed opposite to the end of the needle valve stem, a yieldable abutment is biased by a second spring toward the stem and normally retained a preassigned distance away therefrom. When acted upon by each pressurized fuel charge trapped in the storage chamber, the needle valve is unseated to open the spray orifices against the force of the first spring if the fuel pressure is relatively low, and against the resultant of the forces of the first and second springs if the fuel pressure is higher.

6 Claims, 4 Drawing Figures

FUEL INJECTION NOZZLE AND HOLDER ASSEMBLY FOR INTERNAL COMBUSTION ENGINES

BACKGROUND OF THE INVENTION

This invention relates to a fuel injection device, and more specifically to a fuel injection nozzle and holder assembly of the type incorporating a spring-loaded needle valve for the delivery of metered charges of fuel under pressure into a combustion chamber of, typically, a diesel engine.

A typical conventional diesel fuel injection nozzle and holder assembly of the type under consideration, for use with a jerk pump, has a tubular nozzle holder closed at one end by a cap having a fuel inlet and at the other end by a nozzle having spray holes. The nozzle holder defines a storage chamber for temporarily storing each incoming charge of pressurized diesel fuel. Mounted in the storage chamber are a check valve and a needle valve which are biased by a compression spring in opposite directions. The check valve, sprung against the nozzle holder cap, allows communication between the fuel inlet and the storage chamber only during the delivery of each pressurized fuel charge from the jerk pump. The needle valve, on the other hand, is spring loaded into abutment against a valve seat at the tip of the nozzle, normally holding the spray holes closed.

As the check valve blocks communication between fuel inlet and storage chamber upon admission of each required amount of pressurized fuel into the latter, the fuel pressure in the storage chamber unseats the needle valve against the bias of the compression spring. With the spray holes thus uncovered, the fuel is sprayed into the combustion chamber of a diesel engine cylinder, therein to be ignited by the high temperature air at the end of the compression stroke.

This well known type of fuel injection nozzle and holder assembly has problems arising from the fact that the force of the single compression spring determines the fuel pressure needed to unseat the needle valve. For engine operation under light load the spring force resisting the unseating of the needle valve should be sufficiently small to allow the valve to uncover the spray holes under low fuel pressure. However, such small spring force adversely affects engine performance when it is heavily loaded. Since then the fuel pressure in the storage chamber is higher, the needle valve will rapidly rise away from the valve seat upon discommunication of the storage chamber from the fuel inlet by the check valve. The fuel will then be injected abruptly and at unduly high peak pressure into the combustion chamber, causing a sudden pressure rise therein due to combustion and resulting in great noise production and exhaust emission.

These difficulties during engine operation under heavy load can be obviated, of course, by making the force of the compression spring greater. But then the spring force will be too great for proper fuel injection at low pressure during engine operation under light load. Thus the conventional fuel injection nozzle and holder assembly with the single compression spring is unable to meet the contradictory requirements imposed thereon during engine operation under the different conditions.

SUMMARY OF THE INVENTION

The present invention defeats the foregoing difficulties of the prior art and provides an improved fuel injection device capable of spraying fuel into the combustion chamber of an engine cylinder in an optimum manner irrespective of the varying pressure at which the fuel is delivered to the device. The fuel injection device is also well calculated to admit required amounts of fuel into its storage chamber even if the maximum allowable stroke of the needle valve incorporated therein is lessened for proper fuel injection and longer working life.

Stated in brief, the fuel injection device in accordance with the invention includes a body having a fuel inlet for admitting fuel under pressure from a suitable source of such pressurized fuel, a storage chamber for receiving the pressurized fuel from the fuel inlet, and a spray orifice or orifices for spraying the pressurized fuel from the storage chamber. Mounted within the body is a needle valve loaded by a first spring for normally holding the spray orifices closed. An yieldable abutment is also mounted within the body in end-to-end relation with the needle valve. The abutment is biased by a second spring toward the needle valve and normally retained a prescribed distance away therefrom.

Thus, when acted upon by the pressurized fuel in the storage chamber, the needle valve is unseated only against the force of the first spring if the fuel in the storage chamber is at relatively low pressure, as when the engine is under light load, because then the device completes fuel injection before the needle valve rises into contact with the yieldable abutment. If the engine is more heavily loaded and, is consequence, the fuel pressure is higher, on the other hand, then the needle valve rises an additional distance after engagement with the yieldable abutment, against the resultant of the forces of the first and second springs. Sprayed in this manner, the high pressure fuel causes no uncontrolled combustion and resulting pressure rise in the combustion chamber.

Preferably the fuel injection device takes the form of a nozzle and holder assembly, with the mentioned body comprised of a nozzle having the spray orifices, a tubular nozzle holder carrying the nozzle on one end and defining the storage chamber in combination therewith, and a cap closing the other end of the nozzle holder and having the fuel inlet. The nozzle and holder assembly further comprises a check valve slidably fitted over the stem of the needle valve and loaded by the first spring for blocking communication between the fuel inlet and the storage chamber upon admission of each charge of pressurized fuel into the latter. Normally urged against a partition of the nozzle holder, the check valve defines an inlet chamber which is in constant communication with the fuel inlet and which is to be placed in and out of communication with the storage chamber by the check valve. The yieldable abutment extends through the nozzle holder partition into the noted end-to-end relation with the needle valve stem.

According to an additional feature of the invention the fuel inlet communicates with the inlet chamber via a passageway opening to the latter at a point offset from the end of the needle valve stem. In this manner, even if the spacing between the opposed ends of the needle valve stem and the yieldable abutment is reduced to a minimum required degree for lessening the maximum stroke of the needle valve, the pressurized fuel can flow smoothly into the inlet chamber and thence into the storage chamber.

The above and other features and advantages of this invention and the manner of attaining them will become more apparent, and the invention itself will best be understood, from a study of the following description of preferred embodiments taken together with the attached drawings.

DESCRIPTION OF THE PREFERRED EMBODIMENTS

Figure 1:
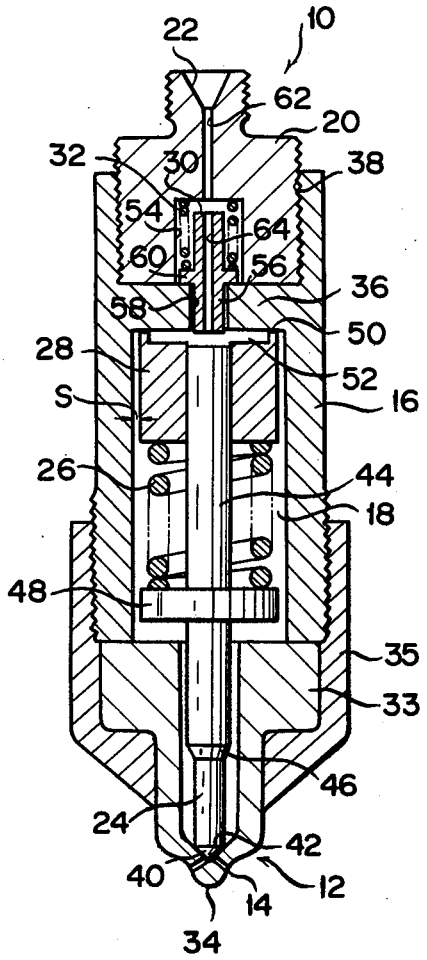
FIG. 1 is an axial section through the nozzle and holder assembly constructed in accordance with the invention, the assembly being intended for fuel injection into the combustion chamber of a diesel engine cylinder by receiving precise amounts of fuel under pressure from a jerk pump.

FIG. 1 shows a preferred form of the fuel injection nozzle and holder assembly in accordance with the invention as adapted for use with a jerk pump for fuel delivery into a diesel engine cylinder. Generally designated 10, the nozzle and holder assembly broadly comprises:

1. A nozzle 12 having one or more spray orifices 14 formed therein.
2. A tubular nozzle holder 16 carrying the nozzle 12 on one end and defining, in combination therewith, a storage chamber 18 for receiving successive metered charges of fuel under pressure from a jerk pump (not shown).
3. A threaded cap or plug 20 inserted into the other end of the nozzle holder 16 and having formed therein a fuel inlet 22 for admission of the pressurized fuel charges into the storage chamber 18.
4. A needle valve 24 disposed in the storage chamber 18 and loaded by a first helical compression spring 26 to open the spray orifices 14 in response to the fuel pressure in the storage chamber.
5. A check valve 28 for blocking communication between fuel inlet 22 and storage chamber 18 upon introduction of each charge of pressurized fuel from the former into the latter.
6. A yieldable abutment 30 loaded by a second helical compression spring 32 and disposed end to end with the needle valve 24, normally with a preassigned spacing therebetween.

The nozzle 12 integrally comprises a nozzle body 33 held against one end of the nozzle holder 16, and a nozzle tip 34 having the spray orifices 14. A nozzle retainer nut 35 secures the nozzle 12 to the nozzle holder 16, with the nozzle tip 34 projecting out of the nut. The nozzle holder 16 has a partition 36 bounding one end of the storage chamber 18 and forming a bottom of an internally threaded bore 38. Threaded externally, the nozzle holder cap 20 is driven fully into the bore 38 for abutment against the partition 36. Although the nozzle 12, the nozzle holder 16 and the nozzle holder cap 20 form separate entities to facilitate manufacture and repair, they should be considered a unitary body for the purposes of the invention taken in its broader aspect.

The needle valve 24 has a conical tip 40 normally resting on a valve seat 42, formed on the inside surface of the nozzle tip 34, under the bias of the first spring 26 for covering the spray orifices 14. A stem 44 extends upwardly or outwardly from the needle valve 24 in collinear relation thereto and normally terminates short of the partition 36 of the nozzle holder 16. The stem 44 is of greater diameter than the needle valve 24, with a tapered shoulder 46 formed at the transition therebetween. Here again the stem 44 may be considered a part of the needle valve 24. A disc-like spring retainer 48 is formed on the needle valve stem 44. The first spring 26 extends between this spring retainer and the check valve 28, encircling the stem, and exerts a downward force on the needle valve 24 to normally hold the same seated against the nozzle tip 34.

The check valve 28 takes the form of a cylinder, with a diameter appropriately less than the diameter of the storage chamber 18 in the nozzle holder 16, having an annular rim 50 projecting from one of its ends. Slidably fitted over the needle valve stem 44, the check valve 28 is biased upwardly by the first spring 26, normally with its rim 50 held against the nozzle holder partition 36 to bound an inlet chamber 52 in constant communication with the fuel inlet 22 in the nozzle holder cap 20. Upon delivery of pressurized fuel into the inlet chamber 52, the check valve 28 descends against the force of the first spring 26. Since the check valve 28 is smaller in diameter than the storage chamber 18 as aforesaid, the fuel flows from the inlet chamber into the storage chamber via the tubular space S between the inner surface of the nozzle holder and the outer surface of the check valve.

Mounted mostly in a downwardly open spring chamber 54 in the nozzle holder cap 20, the yieldable abutment 30 has a portion 56 slidably extending downwardly through a bore 58 of reduced diameter formed axially through the nozzle holder partition 36. A collar 60 on the abutment 30 engages one end of the second spring 32, the other end of which abuts against the top wall of the spring chamber 54. When this abutment is in the illustrated normal position, with its collar 60 held against the nozzle holder partition 36 under the bias of the second spring 32, the end portion 56 of the abutment projects slightly out of the nozzle holder partition and into the inlet chamber 52. The abutment 30 is thus disposed end to end with the needle valve stem 44, normally with a prescribed spacing therebetween. The abutment coacts with the needle valve to control fuel injection into a diesel engine cylinder. The manner of their coaction, as well as the spacing between their opposed ends, will be explained in detail in the subsequent description of operation.

For the introduction of pressurized fuel from the fuel inlet 22 to the inlet chamber 52, this particular embodiment employs a passageway 62 extending axially through the nozzle holder cap 20 and another passageway 64 extending through the yieldable abutment 30. Thus the fuel inlet 22 communicates with the inlet chamber 52 by way of the passageways 62 and 64 and the spring chamber 54 therebetween.

In operation each charge of pressurized diesel fuel from the unshown jerk pump enters the fuel injection nozzle and holder assembly 10 through the fuel inlet 22 in its cap 20. Within the nozzle and holder assembly the pressurized fuel flows into the spring chamber 54 via the passageway 62 and thence into the inlet chamber 52 via the passageway 64. When the fuel pressure in the inlet chamber 52 builds up to such an extent as to overcome the counteractive force of the first spring 26, the check valve 28 yields and opens the inlet chamber, allowing the fuel to flow into the storage chamber 18 via the space S between its outer surface and the opposed inner surface of the nozzle holder 16. The first spring 26 holds the needle valve 24 bottomed against the valve seat 42 of the nozzle tip 34 during such inflow of the fuel into the storage chamber 18.

Upon completion of the delivery of the fuel charge from the jerk pump the first spring 26 coacts with the fuel pressure in the storage chamber 18 to cause upward motion of the check valve 28 back into abutment against the nozzle holder partition 36. With the inlet chamber 52 thus reclosed, the fuel pressure therein drops rapidly. Consequently the fuel pressure in the storage chamber 18 becomes higher than that in the inlet chamber 52, to such an extent that the net fuel pressure acting on the taper shoulder 46 of the needle valve 24 unseats the same from the nozzle tip 34. Thus is the fuel sprayed into the combustion chamber of the unshown diesel engine cylinder through the spray orifices 14 in the nozzle tip.

Figure 2:
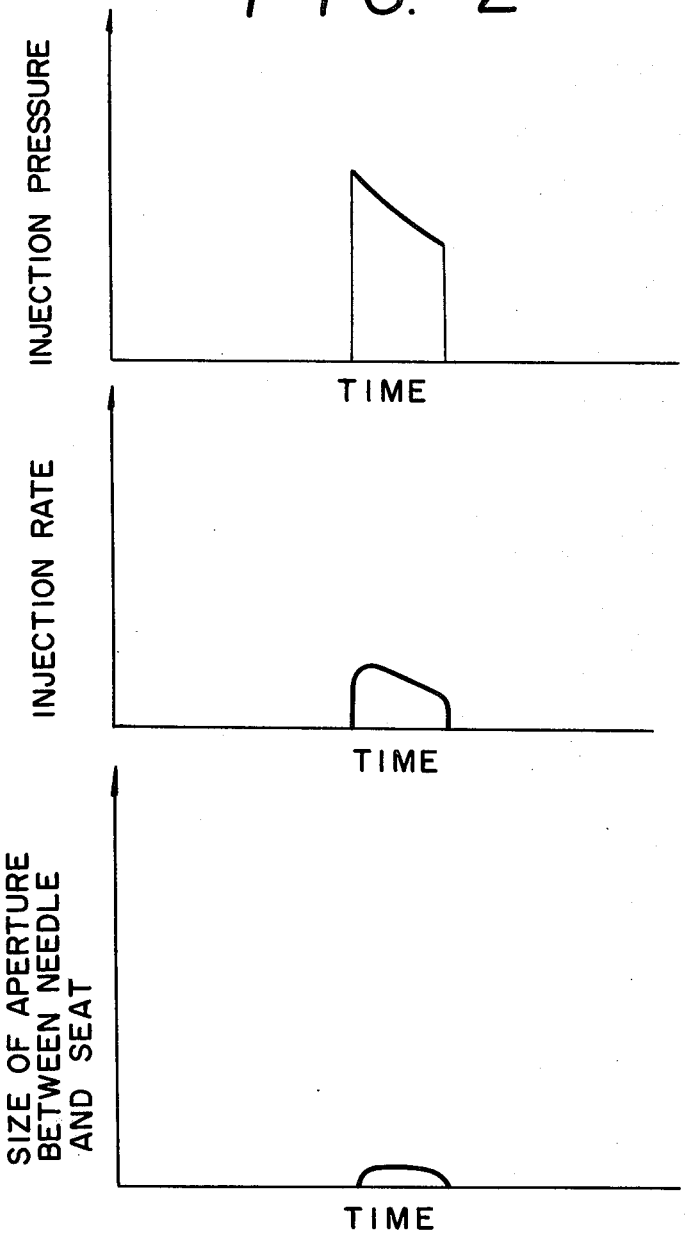
FIG. 2 represents graphs useful in explaining the performance of the nozzle and holder assembly of FIG. 1 when the fuel pressure is low.

An important operational feature of the fuel injection nozzle and holder assembly 10 in accordance with the invention is that the needle valve 24 becomes unseated either against the force of only the first spring 26 or against the combined forces of the first 26 and second 32 springs, depending upon the pressure of the fuel charge trapped in the storage chamber 18 as above. Let it first be assumed that the diesel engine is now operating under light load. Since then the pressure of the fuel trapped in the storage chamber (nozzle opening pressure) is low, the nozzle and holder assembly completes fuel injection as the needle valve 24 rises against the bias of the first spring 26 only, that is, before its stem 44 comes into contact with the yieldable abutment 30. Consequently the nozzle and holder assembly delivers a small amount of fuel at low pressure into the combustion chamber, against the compressed air therein at the end of the compression stroke. The three graphs combinedly given as FIG. 2 explain such performance of the nozzle and holder assembly during the light load operation of the engine.

The fuel injection nozzle and holder assembly 10 operates differently when the engine is loaded more heavily. Since then the nozzle opening pressure of the fuel in the storage chamber 18 is higher, fuel injection does not end before the needle valve stem 44 comes into engagement with the yieldable abutment 30 but continues as the needle valve rises some additional distance with the abutment. Thus the needle valve is unseated first against the force of the first spring 26 only and then against the resultant of the forces of the two springs 26 and 32. In fact the needle valve rises instantly against the combined forces of the springs 26 and 32. The fuel pressure in the storage chamber 18 decreases, of course, with the progress of fuel injection. When the resultant of the spring forces defeats the upward force exerted on the needle valve by the fuel pressure, the needle valve starts descending and comes to rest on the valve seat 42 to terminate fuel injection.

Figure 3:
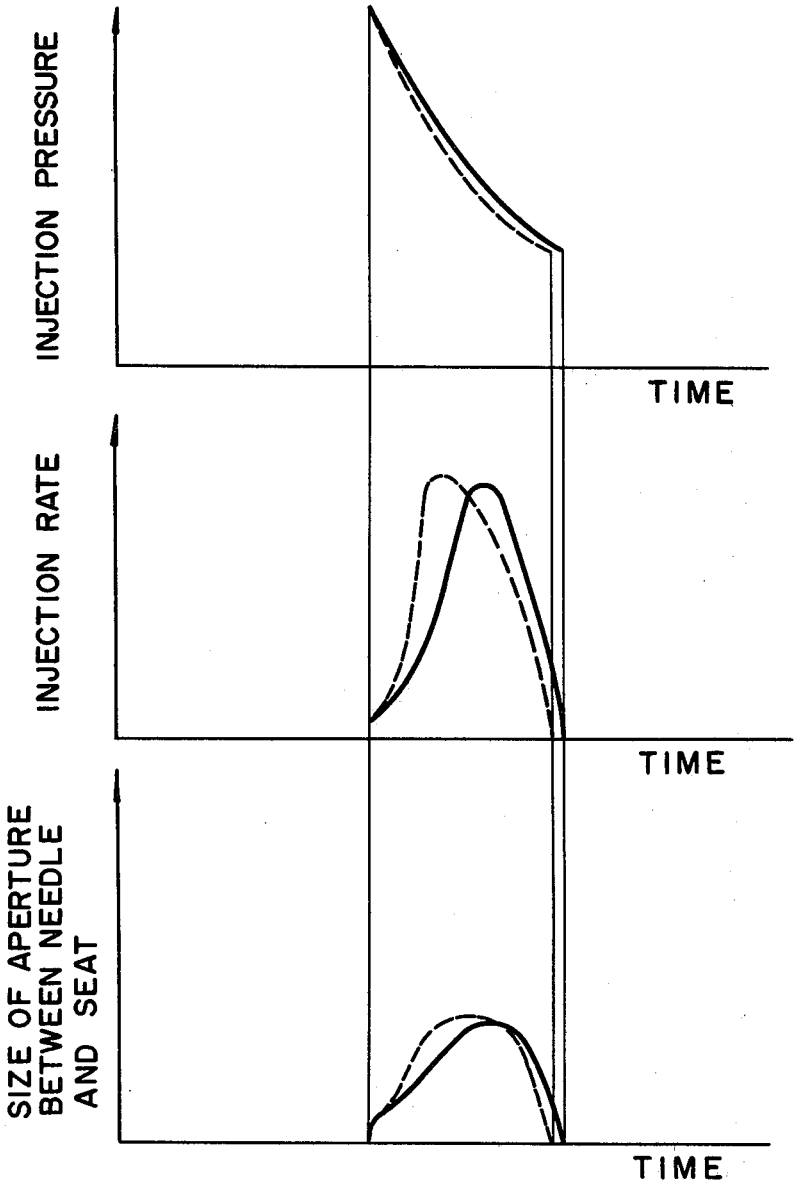
FIG. 3 represents similar graphs useful in explaining the performance of the nozzle and holder assembly when the fuel pressure is high.

The graphs of FIG. 3 represent such performance of the nozzle and holder assembly during the heavy load operation of the engine. It will be noted that the peak injection comes with some delay after the instant the spray orifices 14 start opening. This means that the nozzle and holder assembly makes no abrupt delivery of high pressure fuel into the engine combustion chamber, precluding the possibility of rapid pressure rise therein due to combustion and making possible the reduction of noise and pollutant emission.

The nozzle and holder assembly in accordance with the invention offers another advantage, that is, that the yieldable abutment 30 with the compression spring 32 acts as a shock absorber when the needle valve 24 is unseated into engagement with the abutment. Contrastively, in the noted prior art nozzle and holder assembly, the needle valve has been allowed to move into direct contact with the cap of the nozzle holder against the force of one spring.

As is apparent from the foregoing description of operation, the creation of an appropriate spacing between the opposed ends of yieldable abutment 30 and needle valve stem 44 is essential for the functioning of the nozzle and holder assembly in the intended manner. A factor that merits consideration in the determination of this spacing is the fact that the maximum stroke of the needle valve should not be so long as to impede proper fuel injection or to reduce the useful life of the assembly. For this reason the abutment and the needle valve stem should be spaced to a minimum required degree. In the nozzle and holder assembly 10 of FIG. 1, however, a problem arises from the reduction of the spacing. Since the fuel under pressure enters the inlet chamber 52 from the passageway 64 in the yieldable abutment 30, the reduction of the spacing between this abutment and the needle valve stem 44 might impede the fuel flow into the inlet chamber and thence into the storage chamber 18. Consequently the desired amounts of fuel might not be introduced into the storage chamber, particularly if the engine was running at high speed or under heavy load.

Figure 4:
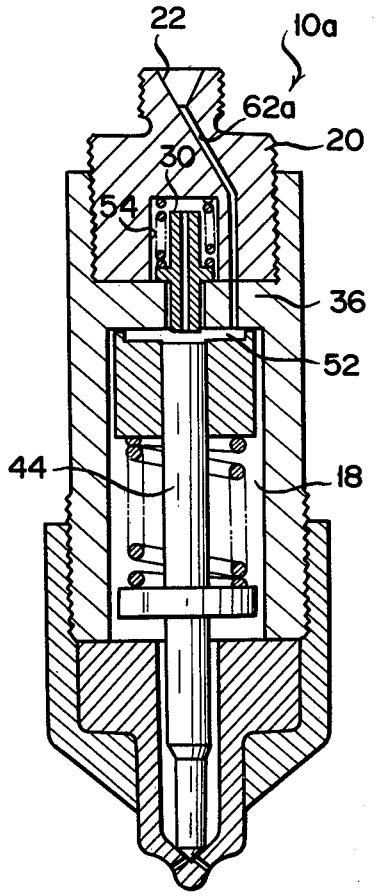
FIG. 4 is an axial section through an alternative form of the nozzle and holder assembly in accordance with the invention.

For the solution of this problem the invention provides an alternative form of the fuel injection nozzle and holder assembly, shown in FIG. 4 and generally labeled **10*a*. The alternative nozzle and holder assembly 10*a* features a passageway 62*a* extending from the fuel inlet 22 through the nozzle holder cap 20 and the nozzle holder partition 36 and opening to the inlet chamber 52 at a point offset from the end of the needle valve stem 44, thus bypassing the spring chamber 54 and the yieldable abutment 30. Thus, even if the spacing between yieldable abutment and needle valve stem is reduced to a minimum, the fuel can flow smoothly into the inlet chamber 52 and thence into the storage chamber 18. The other details of construction and operation are as previously set forth in connection with the nozzle and holder assembly 10 of FIG. 1**.

It will be easy for the engine specialists to modify the illustrated examples of the nozzle and holder assembly to conform to design preferences or to requirements of specific applications. These embodiments should not, therefore, be taken as a definition of the scope of the invention, reference being had for this purpose to the appended claims.

What is claimed is:

1. A device for the injection of fuel under pressure into a combustion chamber of an internal combustion engine, comprising:

(a) a body having formed therein a fuel inlet for admitting pressurized fuel, a storage chamber for receiving the incoming pressurized fuel, and a spray orifice for discharging in the form of droplets the pressurized fuel from the storage chamber (b) a first spring within the body;

(c) a needle valve, including a stem, within the body for covering and uncovering the spray orifice, the needle valve being normally held in a position to cover the spray orifice under the bias of the first spring and adapted to be acted upon by the pressurized fuel in the storage chamber for uncovering the spray orifice against the bias of the first spring;

(d) a check valve slidably fitted over the stem of the needle valve and acted upon by the first spring for blocking communication between the fuel inlet and the storage chamber upon admission of each required amount of pressurized fuel into the storage chamber;

(e) a second spring within the body;

(f) a yieldable abutment disposed opposite to an end of the needle valve, the abutment being biased by the second spring toward the needle valve and normally retained a prescribed distance away therefrom; and (g) whereby the needle valve is unseated to uncover the spray orifice only against the force of the first spring when the fuel introduced into the storage chamber is at relatively low pressure, and against the resultant of the forces of the first and the second springs when the fuel in the storage chamber is at higher pressure.

2. The fuel injection device of claim 1, wherein the check valve defines, in combination with the body, an inlet chamber which is in constant communication with the fuel inlet and which is to be placed in and out of communication with the storage chamber by the check valve.

3. The fuel injection device of claim 2, wherein the fuel inlet communicates with the inlet chamber via a passageway extending through the yieldable abutment.

4. The fuel injection device of claim 2, wherein the fuel inlet communicates with the inlet chamber via a passageway opening to the latter at a point offset from the stem of the needle valve.

5. A nozzle and holder assembly for the injection of fuel under pressure into a combustion chamber of an internal combustion engine, comprising:

(a) a nozzle having a spray orifice formed therein;

(b) a nozzle holder carrying the nozzle on one end and defining, in combination therewith, a storage chamber for receiving successive charges of fuel under pressure, the nozzle holder having a partition bounding one end of the storage chamber;

(c) a cap engaged with another end of the nozzle holder and having formed therein a fuel inlet for admitting the pressurized fuel charges into the storage chamber, the cap also having a spring chamber formed therein;

(d) a first spring in the storage chamber;

(e) a needle valve in the storage chamber, the needle valve being normally seated against the nozzle for covering the spray orifice under the bias of the first spring and adapted to be acted upon by the pressurized fuel in the storage chamber for uncovering the spray orifice against the bias of the first spring;

(f) the needle valve having a stem collinearly extending therefrom toward the partition of the nozzle holder;

(g) a check valve slidably fitted over the stem of the needle valve and normally held under the bias of the first spring against the partition of the nozzle holder to bound an inlet chamber in constant communication with the fuel inlet in the cap, the check valve yielding against the bias of the first spring to allow introduction of the pressurized fuel from the fuel inlet into the storage chamber via the inlet chamber;

(h) a second spring in the spring chamber in the cap; and (i) a yieldable abutment mounted in the spring chamber in the cap and extending through a bore in the partition of the nozzle holder to have one end held opposite to the end of the stem of the needle valve, the abutment being biased by the second spring toward the stem and normally retained a prescribed distance away therefrom;

(j) whereby the needle valve is unseated to uncover the spray orifice in the nozzle either against the force of the first spring or against the resultant of the forces of the first and the second springs depending upon the pressure of the fuel charge trapped in the storage chamber.

6. The fuel injection nozzle and holder assembly of claim 5, wherein the fuel inlet communicates with the inlet chamber via a passageway extending through the cap and the partition and opening to the inlet chamber at a point offset from the end of the stem of the needle valve.

* * * * *